US006824232B2

(12) United States Patent
Farmer

(10) Patent No.: US 6,824,232 B2
(45) Date of Patent: Nov. 30, 2004

(54) BUREAU HOUSING WITH BASKETS LAUNDRY SYSTEM

(76) Inventor: Irene M Farmer, 1316 Shelmire Ave., Philadelphia, PA (US) 19111

( * ) Notice: Subject to any disclaimer, the term of this patent is extended or adjusted under 35 U.S.C. 154(b) by 0 days.

(21) Appl. No.: 09/934,516

(22) Filed: Jan. 10, 2002

(65) Prior Publication Data

US 2004/0085008 A1 May 6, 2004

(51) Int. Cl.[7] ..... A47B 47/00; A47B 47/04; A47B 88/00; A47B 88/04; A47B 88/20

(52) U.S. Cl. ..... 312/293.2; 312/330.1; 312/334.7; 312/334.44; 312/348.3

(58) Field of Search ..... 312/293.2, 330.1, 312/334.7, 334.44, 348.3

(56) References Cited

U.S. PATENT DOCUMENTS

| | | | | | |
|---|---|---|---|---|---|
| 1,468,213 | A | * | 9/1923 | Clayton | 312/348.3 |
| 2,306,802 | A | * | 12/1942 | Harbison | 312/334.7 X |
| 3,087,764 | A | * | 4/1963 | Schless et al. | 312/334.7 X |
| 3,722,975 | A | * | 3/1973 | Taylor | 312/334.44 |
| 5,490,724 | A | * | 2/1996 | Domenig | 312/334.44 X |
| 5,975,660 | A | * | 11/1999 | Tisbo et al. | 312/263 |
| 6,099,092 | A | * | 8/2000 | Uffner et al. | 312/108 |
| 6,357,844 | B1 | * | 3/2002 | Muterthies et al. | 312/348.3 |
| 2002/0043914 | A1 | * | 4/2002 | Munday et al. | 312/334.7 |

FOREIGN PATENT DOCUMENTS

| | | | | | |
|---|---|---|---|---|---|
| DE | 4210017 | A1 | * | 10/1992 | 312/334.44 |
| GB | 2214410 | A | * | 9/1989 | 312/334.44 |
| JP | 06245831 | A | * | 9/1994 | 312/334.44 |

OTHER PUBLICATIONS

Mils Pride Cabinet.

* cited by examiner

*Primary Examiner*—Rodney B. White

(57) ABSTRACT

The furniture box and laundry hamper system of the main embodiment has grooves in the interior of the sides of the box to accept plastic baskets. The 1" groove will widen toward the front of the sidewall the last 17% of the groove to a 2" groove. This will keep the basket from falling out when pulled too far forward. One object of invention is to provide simplicity of construction. The grooves will replace drawer slides and rollers in cabinets. The grooves will afford easy removal of the baskets. A smaller box structure with heretofore mentioned grooves shall be used for a hamper. The basket will have a reinforced tubular rim to provide strength and easy gripping and openings in the rim to receive the fingers of a user and act as handles for. The sides will slant for ease of carrying. The plastic shall be clear for easy viewing of articles. A T-shaped separator or partition made of hard plastic will be used for insertion into the basket for separation of articles of clothing. The design of the laundry hamper will allow for easy storage and transporting of clothes for laundry purposes. Time will be saved by not having to transfer soiled clothing from hamper to basket and clean clothes from basket to drawer since the basket is in lieu of the drawer.

7 Claims, 2 Drawing Sheets

BUREAU HOUSING WITH BASKETS LAUNDRY SYSTEM

BACKGROUND OF THE INVENTION

Previous bureaus are stationary housings for clothes. U.S. Pat. Nos. 3,338,651, 4,848,580, 5,118,173, 5,145,062, 5,785,402, 5,816,674, and 5,829,767, disclose various cabinets, carts, stackable containers, hampers, drawers, and handles for carrying purposes. They have one purpose: storage. Drawers are not deep enough to store bulky clothes such as heavy sweaters and sweats shirts. They are not mobile or versatile. They must be placed on a slide to open. The slides can break. Stop members must be added separately. Stackable container assemblies are mobile but lack stability for storing heavy laundry, etc. They will tumble over when the drawer is pulled too far forward. There is no sense of furniture style. Their placement in the home is limited. Hampers are box like storage pieces and have limited use. One purpose is temporary storage of accumulated soiled clothes. Some hampers are portable but cannot become part of the bureau housing.

The primary object of my invention is to ease the process of storing clean clothes, transporting of dirty clothes to washer, and return to storage in the same baskets.

Another object of the invention is to make improvements in bureaus and other similar objects.

Another object of the invention is to construct a housing designed to house a plurality of baskets.

Another object of the invention is to improve the design of the laundry hamper that will allow for easy storage and transporting of clothes for laundry purposes.

Another object of the invention is to make the addition of stop members to the drawers and cabinets unnecessary.

Another object of my invention is a replacement for modular storage facilities by using pressed wood or an appropriate substitute such as plywood or molded plastic with heretofore-mentioned grooves to simplify and improve the speed of construction and assembly by eliminating the need for gluing panels together since the design is in the panel itself. This invention provides greater simplicity of construction Another object of my invention is providing a plastic molded basket that does not break on impact if dropped. In relation to food storage receptacles for refrigeration, my invention could replace the sides in refrigerators and storage receptacles by replacing the sides of the unit when fashioned in molded plastic and using appropriate size baskets, thus simplifying construction and reducing production costs.

Yet another object of the invention is that time will be saved by not having to transfer soiled clothing from hamper to basket and clean clothes from basket to drawer since the basket is in lieu of the drawer. It allows for improved storage of clothes, especially bulky items such as sweatshirts. The system of doing laundry and its storage is improved by not having to transfer clothes continuously from bureau to drawer to hamper to basket to appliances to basket and back to bureau. It is less expensive and resilient than all wood and has the advantage of being environmentally friendly.

The special desired basket when emptied of clean clothes is placed in the hamper box where the soiled clothes that were deposited into the hamper basket are removed and transported to the laundry area to be cleaned in the washing machine. After drying, clothes are placed in the same basket, separated with separators or partitions, if necessary, and then returned to the empty grooves in furniture piece. This process eliminates the need for transferring clothes into a basket and out of the basket several times prior to and including entering the bureau housing into furniture piece.

The above and other details of the invention, including various novel details of construction and combinations of parts, will now be more particularly described with reference to the accompanying drawings. It will be understood that the particular embodiment herein disclosed is presented by way of illustration only and not as a limitation of the invention, and that the principles and features of this invention may be employed in various and numerous embodiments without departing from the scope of the invention.

DETAILED DESCRIPTION OF THE INVENTION

Figure 1:
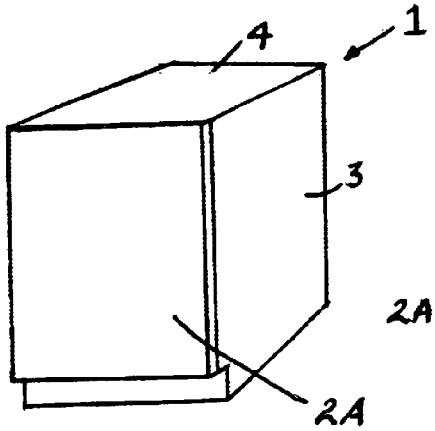
FIG. 1 is a perspective view of one form of housing with a pivotable door attached to the opening of the housing in the closed position.
Figure 2:
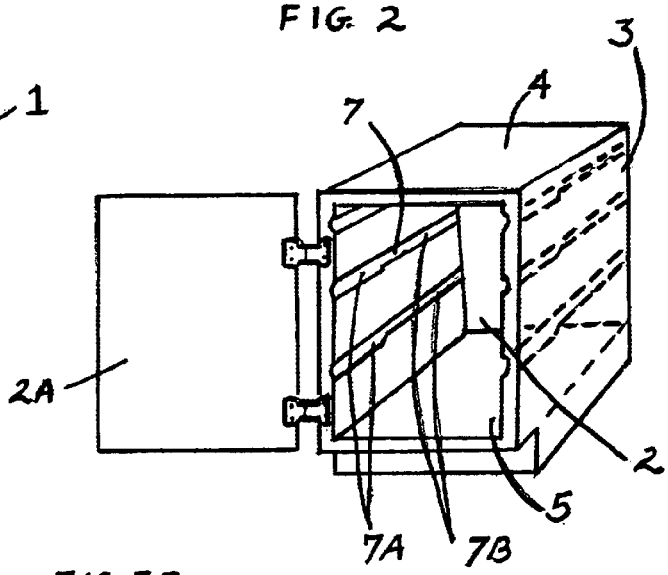
FIG. 2 is a perspective view of the housing with the pivotable door in the open position.
Figure 3A:
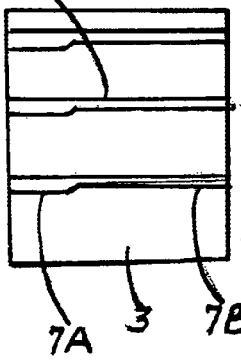
FIG. 3A is a perspective view of the interior side walls of the housing with the grooves routed into the interior sides of the housing.
Figure 3B:
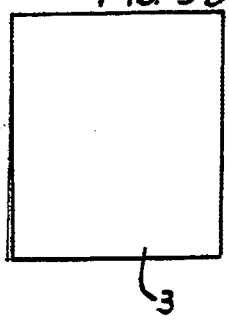
FIG. 3B is a perspective view of the exterior surface of the side walls of the housing of FIGS. 1–2.
Figure 4:
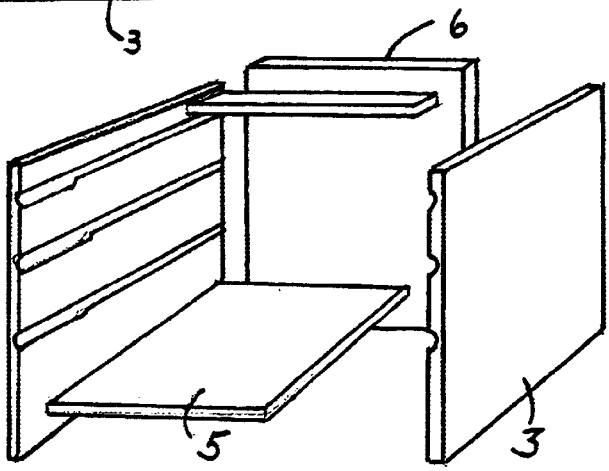
FIG. 4 is an exploded view of the housing of FIGS. 1–2
Figure 5:
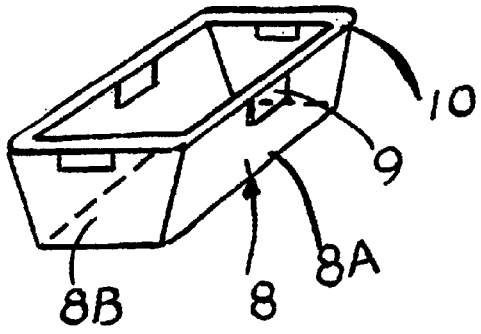
FIG. 5 is a view of a basket with slanted sides with openings in the rim to receive the fingers of a user.
Figure 6:
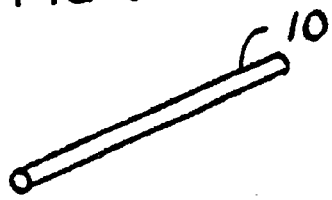
FIG. 6 is the reinforced tubular rim of a basket of the invention.
Figure 7:
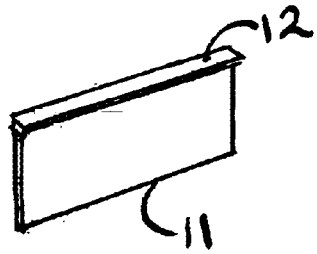
FIG. 7 is a perspective view of a T-shaped separator or partition.

The furniture box and laundry hamper system 1 of the main embodiment, as shown in FIG. 1, has two side walls 3, a top wall 4, a bottom wall 5, a back wall 6, and a front opening 2 to provide access to the interior of the housing. A door 2A is pivotally attached to the front of the cabinet or housing to selectively open or close the front opening 2 to the interior of the cabinet. The door is pivotally attached by hinges well known in the art. The side walls 3 have grooves 7 in the interior of the sides of the box to accept plastic baskets 8, as shown in FIG. 5. The rim 10 of the basket, later described in further detail, cooperates with the grooves 7 to provide sliding movement of the baskets 8 within the housing or cabinet. The grooves 7, shown in FIGS. 2–4, are in the form of a routed groove and replace the need to rely on extruded components to provide sliding movement of the baskets. The grooves 7 are already routed into the interior surface of the side walls of the cabinet prior to construction. The grooves 7 have an ideal depth of 9/16". The grooves 7 have a downwardly facing upper surface and an opposite upwardly facing bottom surface. From one first end of the groove beginning at the back of the sidewall, the back end portion 78 grooves are routed one inch wide for the first 83% of the groove extending from that first end of the groove at the back of the cabinet in a direction toward the front of the sidewall. The front end portion 7A pf the groove have a bottom surface is slanted downward and away from the upper surface edge and the remaining 17% of the groove is two inches wide toward the other end of the groove at the front of the sidewall. The stop is in the design of the groove. The slant on the groove automatically resists unintentional withdrawal of baskets. The slant of the bottom surface of the grooves will allow for a gentle drop of the basket when being pulled forward and prevent unintentional disconnection or falling of the basket out of the cabinet. The baskets 8 have a ¾, tubular rim 10 extending around the upper edge of the basket. The grooves 7 on the interior of the cabinet, as shown in FIGS. 2–4, receive the baskets with the rounded reinforced rim 10, as shown in FIGS. 5–6, to allow sliding movement of the baskets 8 into and out of the cabinets and ease of re-inserting the cabinets into the cabinet when removed. The front end portion 7A of the groove 7 (FIGS. 2–4) will not allow a basket to fall out when overly extended in a forward direction out of the housing and will allow for easy removal of the baskets.

The baskets 8, as shown in FIG. 5, are an integral part of bureau. The rim 10 of FIG. 5, is made of heavy plastic and tubular in shape to fit the hand comfortably. The baskets 8 further include openings or handles 9 to receiving the fingers or hands of the user for gripping purposes. The side walls 8A and end walls 8B of the basket are sloped slightly, or converge toward the bottom of the basket, for easier carrying. Separators or partitions 11, as shown in FIG. 6, are used for insertion into the baskets to help separate and sort clothes. The partition can be made of hard plastic or other suitable materials such as wood. The partition 11 is T-shaped in cross section and is almost as wide but slightly smaller than the width of the basket to allow the partition to fit completely into the basket. The T-section 12 of the partition extends slightly over and rests on the upper surface of the rim of the basket to maintain the partition in a vertical position once it is inserted into the basket. The partition 11 then creates a sectional basket for sorting, separating, or arranging articles of clothing or other items within the basket.

Figure 8:
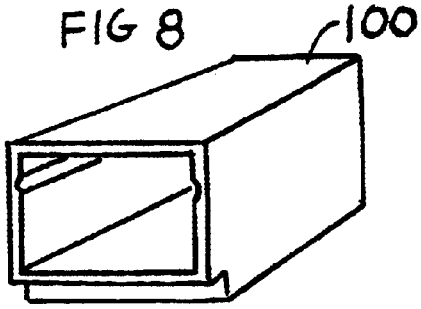
FIG. 8 is a perspective view of a second embodiment of the hamper basket housing.
Figure 9:
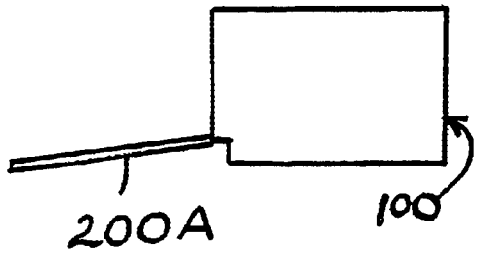
FIG. 9 is a side view of the hamper/bureau housing shown in FIG. 8 with a door attached to a bottom of the opening of the housing, the door in an opened position

FIGS. 8–9 and show another embodiment of the present invention. FIG. 8 shows a smaller cabinet or housing 100 that would receive a basket corresponding in size. FIG. 9 shows a door 200A attached at the front opening f the cabinet, the door being pivotally attached by a horizontal hinge at the bottom of the cabinet instead of the vertical hinge as disclosed in FIG. 2.

The terms "bureau, cabinet, and housing" are not to be understood as a limiting term, i.e. such a storage receptacle can also have various other uses for transportable supplies such as in closets for storage, a kitchen cabinet for vegetables, sheds for gardening equipment, toy storage, tools, etc. Also, the size of the parts and other features, such as the grooves of the side walls and the rims of the baskets are not limited to the aforementioned dimensions and can be formed to specific ratios to correspond to various sizes of housing or cabinets.

What is claimed is:

1. A bureau and laundry hamper comprising:

a housing having an interior;

said housing having two side walls, a top wall, a bottom wall, a back wall, and an opening at a front of said housing to provide access to said interior of said housing;

each of said side walls, top wall, bottom wall, and back wall having an interior surface;

a door pivotally attached to said front of said housing to open or close said front opening to said interior of said housing;

a plurality of baskets insertable and removable from said housing for storing articles of clothing and other items; said baskets having two opposite side walls, two opposite end walls, and a bottom wall that form an interior cavity of said baskets; each of said baskets having a tubular outer rim extending around an outer edge of said baskets;

each of said two side walls having a plurality of oppositely facing pairs of routed grooves on said interior surfaces of said side walls with sufficient depth to receive said tubular outer rim of said baskets and provide sliding movement of said plurality of baskets within said housing; said routed grooves having a downwardly facing upper surface and an opposite upwardly facing bottom surface;

each of said grooves in said side walls having a back end portion having a first end and a second end, said back end portion extending from its first end of said groove beginning at said back wall of said housing and toward said front of said housing to its second end for 83% of said groove, said back end portion of said groove having a first dimension from said upper surface to said bottom surface of said groove;

each of said grooves having a front end portion with a first end and a second end, said front end portion of said groove in said side walls extending from its first end beginning at said second end of said back end portion of said groove to its second end at said front of said housing, said bottom surface of said groove, beginning at the second end of said back end portion of said groove, slants downward and levels out to where said bottom surface is a distance from said upper surface double that of said first dimension of said back end portion of said grooves from said upper surface to said bottom surface, creating the front end portion of said groove with said front end portion of said groove extending to said front of said housing for the remaining 17% of said groove; said front end portion of said groove providing said baskets with a drop for said baskets in preventing inadvertent falling of said baskets out of said housing; and said baskets having removable partitions that extend from one side wall to the other side wall of said baskets; the length of said partitions slightly shorter than the distance between said basket side walls so that said partitions can be inserted into said interior cavity of said baskets; said partitions being T-shaped in cross section; said T-section of said T-shaped partitions extending over and resting on an upper surface of said tubular rim of said baskets to allow said T-shaped partitions to remain in a vertical position when in use, said T-shaped partitions providing said baskets with sections that allow sorting, separation, and arranging of articles of clothing and other items.

2. A bureau and laundry hamper, as in claim 1, wherein said back end portion of each of said routed grooves is one inch and said front end portion of each of said routed grooves is two inches wide.

3. A bureau and laundry hamper, as in claim 1, wherein said routed grooves in said interior surface of said side walls are 9/16 inch deep.

4. A bureau and laundry hamper, as in claim 1, wherein said baskets are made of molded plastic and said tubular rims of said baskets are ¾ inch reinforced tubular rims to fit the hand of a user comfortably for easier carrying of said baskets by a user.

5. A bureau and laundry hamper, as in claim 1, wherein said side walls and end walls of said baskets are slightly sloped, said side walls and said end walls of said baskets converging toward said bottom of said basket for easier carrying of said baskets by a user.

6. A bureau and laundry hamper, as in claim 1, wherein said baskets are made of clear plastic for easy viewing of articles in said baskets.

7. A bureau and laundry hamper, as in claim 1, wherein said baskets further include openings or handles just underneath and adjacent said reinforced tubular rims of said baskets for receiving the fingers or hands of a user for gripping purposes and ease of carrying by the user.

* * * * *